US012246798B2

(12) United States Patent
Kwon et al.

(10) Patent No.: US 12,246,798 B2
(45) Date of Patent: Mar. 11, 2025

(54) AUTOMATED DETACHABLE TYPE SUCTION ANCHOR SYSTEM WITH MULTIPLE PUMP

(71) Applicant: Korea Institute of Ocean Science & Technology [KIOST], Busan (KR)

(72) Inventors: O Soon Kwon, Busan (KR); Hyoun Kang, Busan (KR)

(73) Assignee: Korea Institute of Ocean Science & Technology [KIOST], Busan (KR)

( * ) Notice: Subject to any disclaimer, the term of this patent is extended or adjusted under 35 U.S.C. 154(b) by 117 days.

(21) Appl. No.: 18/227,840

(22) Filed: Jul. 28, 2023

(65) Prior Publication Data

US 2024/0246638 A1 Jul. 25, 2024

(30) Foreign Application Priority Data

Jan. 20, 2023 (KR) ..... 10-2023-0008496

(51) Int. Cl.
*B63B 21/27* (2006.01)

(52) U.S. Cl.
CPC ..... *B63B 21/27* (2013.01)

(58) Field of Classification Search
CPC ..... B63B 21/27; B63B 2021/265; B63B 2021/267; E02D 27/525; E02D 27/52; E02B 2017/0078
See application file for complete search history.

(56) References Cited

U.S. PATENT DOCUMENTS 4,318,641 A * 3/1982 Hogervorst ..... B63B 21/27 405/172
4,432,671 A * 2/1984 Westra ..... B63B 21/27 405/226
5,927,904 A * 7/1999 Treu ..... E02D 7/28 114/313
7,918,287 B2 * 4/2011 Foley ..... E21B 25/18 175/58
8,950,500 B2 * 2/2015 Lieske ..... E21B 43/0122 166/71
11,585,064 B2 * 2/2023 Olsen ..... E02D 7/00

FOREIGN PATENT DOCUMENTS

KR 100768823 B1 10/2007
KR 101184309 B1 9/2012
KR 10-2022-0040156 3/2022

* cited by examiner

*Primary Examiner* — Benjamin F Fiorello
(74) *Attorney, Agent, or Firm* — CM Law PLLC; Robert C. Klinger

(57) ABSTRACT

An automatically-separable suction anchor system including a plurality of pumps is disclosed. The system includes an opening/closing unit including a blocking plate provided at a suction pile while having a through hole and pull-up brackets, and a valve member to cause the interior of the suction pile to selectively communicate with an exterior of the suction pile, a suction device including an operation-supporting tubular body with a suction hole and a pressing opening/closing part configured to enable the suction hole to communicate with the suction pile, a frame including clamps to be selectively coupled to the pull-up brackets, and first and second supports, and an operating pump coupled to the operation-supporting tubular body, the operating pump including a first pump of high capacity and a second pump of high head configured to penetrate the suction pile, and a third pump configured to draw the suction pile, and a control module.

10 Claims, 11 Drawing Sheets

AUTOMATED DETACHABLE TYPE SUCTION ANCHOR SYSTEM WITH MULTIPLE PUMP

RELATED APPLICATION

This patent application claims the benefit and priority of Korean Patent Application No. 10-2023-0008496 filed Jan. 20, 2023, the disclosure of which is incorporated by reference herein in its entirety as part of the present application.

BACKGROUND OF THE INVENTION

Field of the Invention

The present invention relates to an automatically-separable suction anchor system including a plurality of pumps, and more particularly to an automatically-separable suction anchor system including a plurality of pumps, which selects a desired one of the pumps in accordance with a variation in soil quality of a sea bed, thereby being capable of achieving effective penetration of the sea bed with a suction pile, and which includes a high-rigidity frame, thereby being capable of safely pulling up a heavy pile.

Description of Related Art

A suction pile installation method is a method for installing a suction pile under water as a foundation of an underwater structure or an offshore structure. This method is an installation method utilizing action of penetration load according to a reduction in an internal water pressure generated when water present in an interior of the suction pile is drained and a reduction in penetration resistance force caused by the drainage.

When a suction pile is installed in a shallow sea area, a diver installs a suction pile under the condition that the diver directly goes under water. When a suction pile is installed in a deep sea area, an underwater robot is used, in place of the diver. When a suction pile is installed in a shallow sea area or in a deep sea area, a diver, an underwater robot, or an unmanned remotely operated vehicle (ROV) performs tasks such as operation and coupling/separation of a suction pump, opening/closing of a drainage pipe, etc. The suction pump is used when a suction pile is installed. In addition, a drawing pump is used for drawing of a suction pile. In addition, a water pressure gauge, an inclinometer, etc. are installed in order to monitor an installation situation when a suction pile is installed. Accordingly, a diver or an underwater robot is employed when equipment as mentioned above is withdrawn.

As related art associated with suction pile installation, a suction pile penetration apparatus is disclosed in Korean Registered Patent No. 10-0768823 (issued on Oct. 19, 2007). The suction pile penetration apparatus is configured through inclusion of a frame installed at a barge, and is provided with a winch configured to move a suction pile to a sea bed, the suction pile, which is connected to the winch by a wire and is configured to penetrate the sea bed, a pump installed at an upper end of the suction pile and configured to drain sea water filling an interior of the suction pile in order to generate a pressure difference between the interior of the suction pile and an exterior of the suction pile, a guide frame disposed between the winch and the suction pile and configured to maintain a horizontal state of the suction pile when the suction pile penetrates the sea bed, and a control member provided at the winch in order to finely adjust a penetration speed of the suction pile.

In accordance with the above-mentioned suction pile penetration apparatus, it may be possible to prevent the suction pile from being inclined and to reduce a suction pile penetration time because the penetration speed of the suction pile may be finely adjusted when the suction pile penetrates the sea bed. However, a diver or an underwater robot should be employed when it is desired to separate the suction pile from the suction pile penetration apparatus. For this reason, a lot of time is required and high costs are incurred. In particular, when a diver is employed, there is a problem in that safety of the diver is not secured.

Meanwhile, as another related art, a suction pile installation apparatus is disclosed in Korean Registered Patent No. 10-1184309 (issued on Sep. 21, 2012). This suction pile installation apparatus includes a reaction device mounted to an upper portion of a suction pile and configured to penetrate the sea bed with the suction pile by utilizing reaction force to sea water, in addition to a suction pump configured to outwardly drain sea water from an interior of the suction pile. By virtue of the reaction device, it may be possible to easily penetrate the sea bed with the suction pile even when the sea bed is hard and firm.

Even in this case, however, there is a problem in that an underwater robot or a diver should be employed when the suction pile or the reaction device is pulled up after being separated from the suction pile.

As another related art, an automatically-separable suction pile installation apparatus is disclosed in Korean Unexamined Patent Publication No. 10-2022-40156 (issued on Mar. 30, 2022). The automatically-separable suction pile installation apparatus as the other related art includes a connection means separably coupled to fixing carriers provided at a blocking plate of a suction pile. The connection means is configured through inclusion of movable coupling members formed, at opposite sides thereof, with horizontally-extending coupling ends to be selectively coupled to or separated from the fixing carriers, the movable coupling members being coupled to a lower surface of a frame such that the movable coupling members are slidable in a direction parallel to the coupling ends, and a separation actuator coupled to the movable coupling members, to tightly contact a reaction protrusion provided at the blocking plate, the separation actuator being configured to forwardly move an actuation rod in accordance with an actuation signal, thereby causing the movable coupling members to separate the coupling ends from the fixing carriers while moving in a direction reverse to the forward movement direction of the actuation rod.

Since the suction pile and the installation apparatus may be automatically interconnected or separated from each other, there is an advantage in that a diver or an underwater robot is unnecessary. In the automatically-separable suction pile installation apparatus according to the related art, however, there is a problem in that a space in which the movable coupling members and the actuation rod are horizontally movable should be provided because the movable coupling members are configured to move forwards or rearwards with respect to the actuation rod, for coupling or separation thereof to or from the fixing carriers. Since operation spaces of constituent elements for automatic coupling and separation should be formed, there is a problem in that the volume of the installation apparatus is increased.

Meanwhile, the suction pile penetration or installation apparatuses according to the above-mentioned related arts are configured to perform suction using a general pump, without taking into consideration the soil quality of the sea bed which a suction pile will penetrate. For this reason, there is a problem in that penetration of the suction pile may be inefficiently carried out.

In addition, in the suction pile penetration or installation apparatuses according to the above-mentioned related arts, there is a problem in that safety may not be secured when a suction pile, which is heavy, is pulled up, because connection of the suction pile to the penetration apparatus or the installation apparatus is not firm.

SUMMARY OF THE INVENTION

Therefore, the present invention has been made in view of the above problems, and it is an object of the present invention to provide a means capable of efficiently achieving penetration of a suction pile, taking into consideration a variation in soil quality of the sea bed even when soil quality variation occurs in a procedure of penetrating the sea bed with the suction pile.

It is another object of the present invention to provide a means capable of rapidly and easily achieving coupling and separation between a suction pile and a suction device.

It is another object of the present invention to provide a means capable of safely pulling up a heavy suction pile and maintaining air-tight connection between a suction device and the suction pile even when the suction pile is coupled to a clamp.

In accordance with an aspect of the present invention, the above and other objects can be accomplished by the provision of an automatically-separable suction anchor system including an opening/closing unit including a blocking plate including a through hole formed at an upper surface of a suction pile, and pull-up brackets respectively formed at opposite sides with reference to the through hole, to protrude upwards, and a valve member disposed at an interior of the suction pile, to cause the interior of the suction pile to selectively communicate with an exterior of the suction pile, a suction device including an operation-supporting tubular body formed to have a hollow structure formed with a suction hole therein, the operation-supporting tubular body being vertically disposed and provided, at a lower end thereof, with a pressing opening/closing part configured to enable the suction hole to communicate with the interior of the suction pile, a frame including clamps respectively provided at a lower portion of the frame in opposite end regions and configured to be selectively coupled to the pull-up brackets, and first and second supports each formed with upper and lower coupling ends to be coupled to upper and lower portions of the operation-supporting tubular body at opposite sides of the operation-supporting tubular body, respectively, and an operating pump coupled to the operation-supporting tubular body, the operating pump including a first pump of high capacity and a second pump of high head configured to perform penetration of the suction pile through selective operation thereof, and a third pump configured to perform drawing of the suction pile, and a control module provided at the operation-supporting tubular body and configured to control operation of the operating pump and operation of the clamps.

The opening/closing unit may include a hollow fixed tubular member formed with an insertion hole at a central portion thereof while being formed with upper and lower flanges at upper and lower ends thereof, the lower flange being coupled to the blocking plate such that the insertion hole communicates with the interior of the suction pile through the through hole, and the valve member coupled to a lower surface of the lower flange such that the valve member is disposed in the interior of the suction pile, the valve member being configured to open the insertion hole when the pressing opening/closing part performs downward pressing.

The pressing opening/closing part may include a press-supporting flange coupled to a tubular flange provided at a lower end of the operation-supporting tubular body, and a pressing member coupled to the press-supporting flange such that an upper end thereof is disposed at an inner edge of the press-supporting flange, the pressing member being formed with a pressing end at a lower end thereof, to downwardly press the valve member.

The pressing member may include a hollow tube having a conical shape at a lower end thereof while being formed with a plurality of holes, or may include at least two plates coupled to each other, to form a "+" shape, such that a channel is formed therebetween.

An elastic connector may be provided at a lower surface of the press-supporting flange, and the elastic connector may be configured to be brought into tight contact with an upper surface of the upper flange of the fixed tubular member, to maintain air tightness, when the pressing member is inserted into the insertion hole, to downwardly press the valve member, thereby opening the insertion hole, and the clamps are coupled to the frame. The elastic connector may have a hollow structure such that the pressing member is disposed therein, an upper end of the elastic connector is coupled to the lower surface of the press-supporting flange, and an elastic force generating portion configured to generate elastic force in upward and downward directions is formed at a middle portion of the elastic connector.

A protection tubular member may be provided at the lower surface of the press-supporting flange. The protection tubular member may be formed to have a hollow structure such that the elastic connector is disposed therein. The protection tubular member may be coupled to the lower surface of the press-supporting flange at an upper end thereof, to protect the elastic connector. The protection tubular member may be formed to have a smaller length than a length of the elastic connector, to prevent interference thereof with the elastic connector when the elastic connector extends or retracts in an upward or downward direction.

Each of the first and second supports may include a pair of support plates coupled to each other while being spaced apart from each other such that an upper coupling space and a lower coupling space are formed therebetween. A pull-up ring configured to be connected to a crane may be coupled to the upper coupling space. A corresponding one of the pull-up brackets may be inserted into the lower coupling space.

Each of the clamps may include an actuator coupled to an outer one of the support plates of a corresponding one of the first and second supports in a region corresponding to the lower coupling space, and an actuation rod configured to be coupled, in a fitting manner, to frame coupling holes formed at the support plates and a clamp coupling hole formed at a corresponding one of the pull-up brackets in accordance with a forward movement operation of the actuator, thereby integrating the support plates and the corresponding pull-up bracket with each other, the actuator rod also being configured to be separated from the frame coupling holes and the clamp coupling hole in accordance with a backward movement operation of the actuator, thereby separating the support plates and the corresponding pull-up bracket from each other.

An air discharge unit may be provided at the operation-supporting tubular body, to discharge air present in the interior of the suction pile and an interior of the suction hole when the suction device is submerged in sea water. The air discharge unit may include an opening/closing member configured to selectively open or close a discharge hole formed at an upper end of the operation-supporting tubular body, and air-discharging actuators installed at an upper portion of the operation-supporting tubular body and configured to upwardly move the opening/closing member, thereby opening the discharge hole, and to downwardly move the opening/closing member, thereby closing the discharge hole.

The control module may include pressure gauges installed at the operation-supporting tubular body and configured to measure a pressure of the suction hole and a pressure at the outside of the suction hole, respectively, and the control module selectively operates the first pump and the second pump based on the pressure at the inside of the suction hole and the pressure at the outside of the suction hole respectively sensed by the pressure gauges.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, exemplary embodiments of the present disclosure will be described in detail with reference to the accompanying drawings. In the following description, when a detailed description of the relevant known function or configuration is determined to unnecessarily obscure the subject matter of the present disclosure, such detailed description will be omitted.

Figure 1:
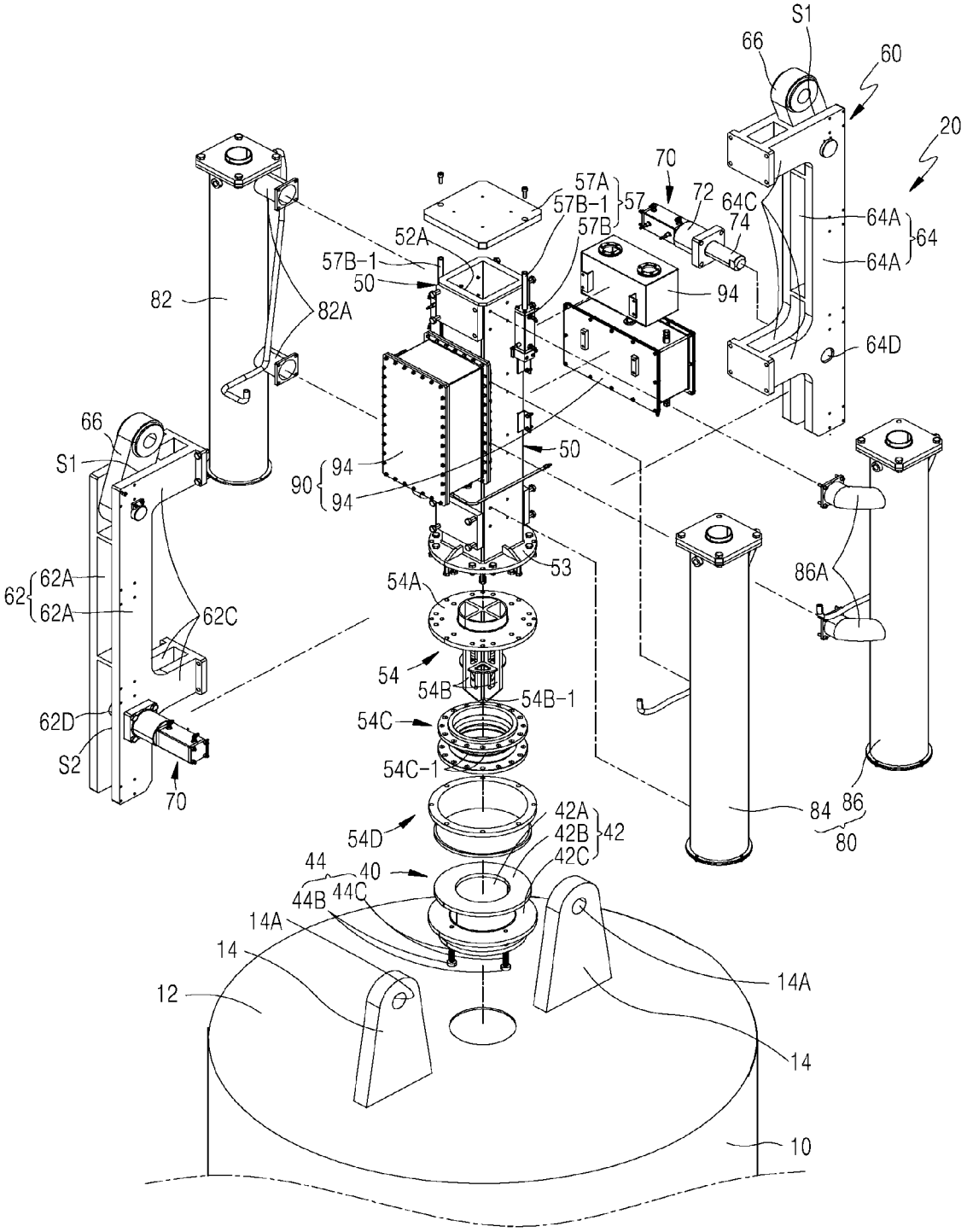
FIG. 1 is an exploded perspective view showing an automatically-separable suction anchor system including a plurality of pumps in accordance with an embodiment of the present invention.
Figure 2:
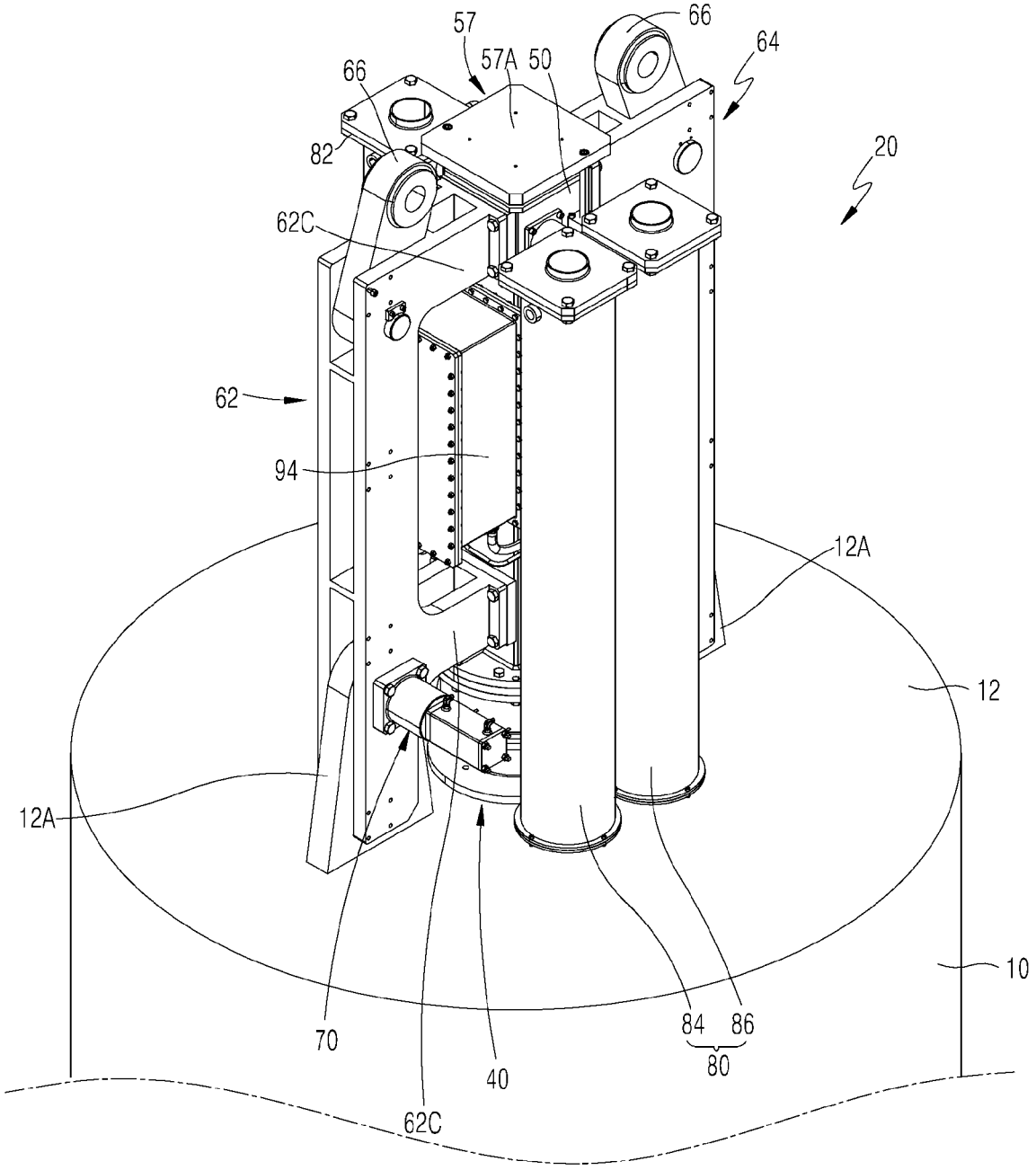
FIG. 2 is a coupled perspective view showing the automatically-separable suction anchor system shown in FIG. 1.
Figure 3:
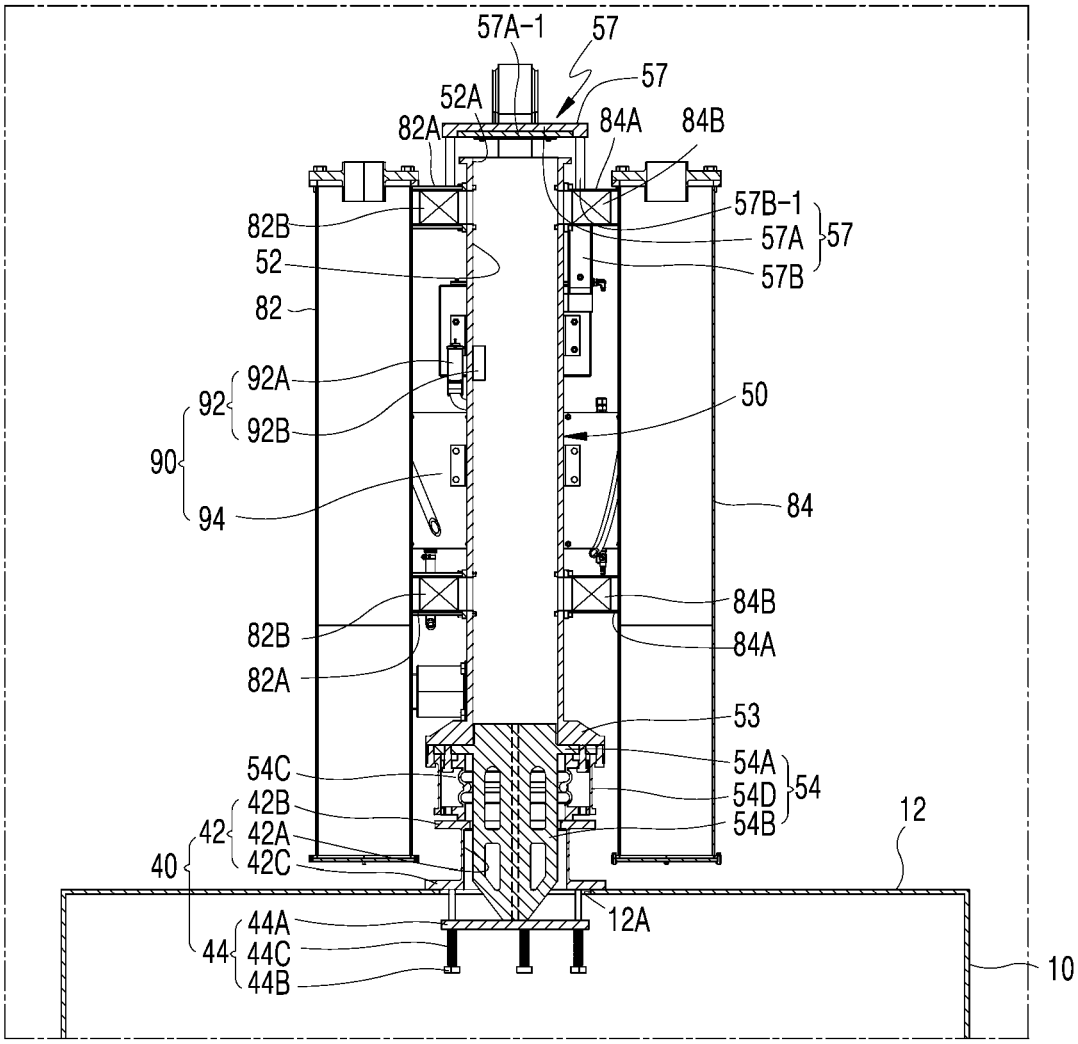
FIG. 3 is a cross-sectional view taken along line A-A in FIG. 2.
Figure 4:
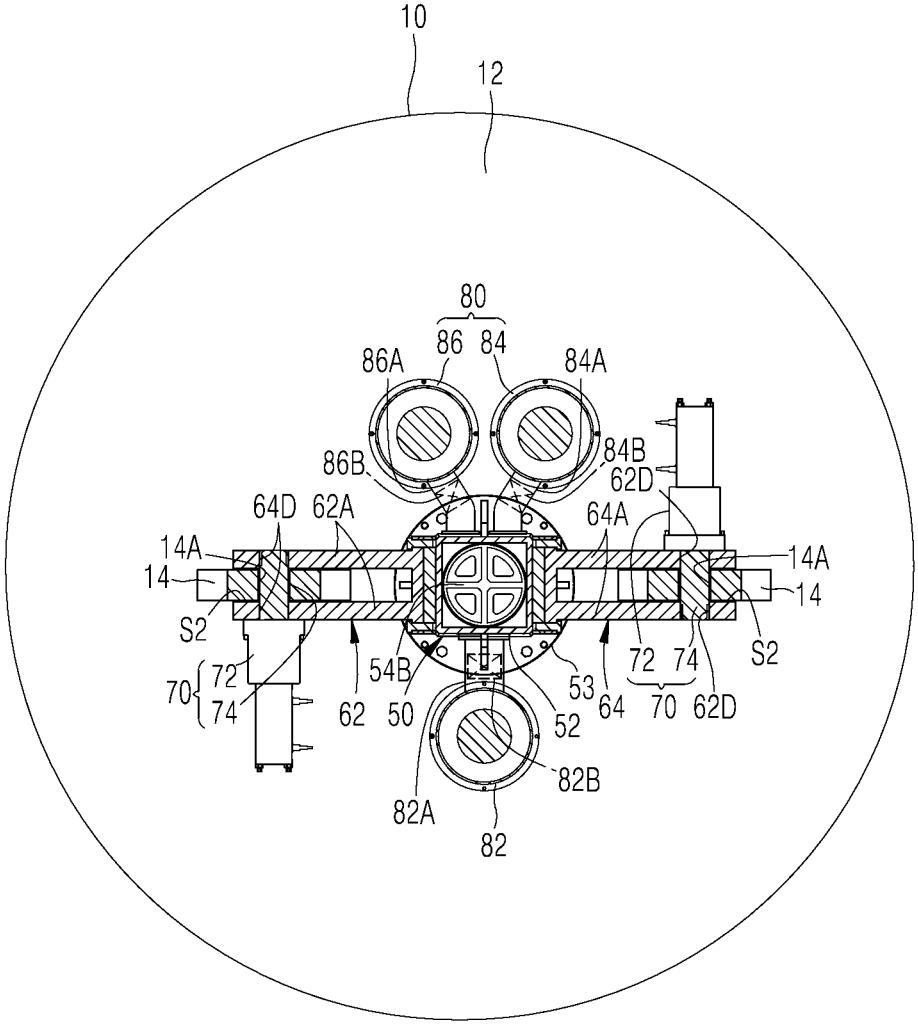
FIG. 4 is a cross-sectional view taken along line B-B.

FIG. 1 is an exploded perspective view showing an automatically-separable suction anchor system including a plurality of pumps in accordance with an embodiment of the present invention. FIG. 2 is a coupled perspective view showing the automatically-separable suction anchor system shown in FIG. 1. FIG. 3 is a cross-sectional view taken along line A-A in FIG. 2. FIG. 4 is a cross-sectional view taken along line B-B.

As shown in FIGS. 1 to 4, the automatically-separable suction anchor system according to the embodiment of the present invention, which includes a plurality of pumps, is configured to automatically connect or couple a modular suction device 20 to an upper end of a suction pile 10 under water, to perform suction operation and drawing operation.

The automatically-separable suction anchor system, which includes a plurality of pumps, includes an opening/closing unit 40 provided at a blocking plate 12 of a suction pile 10 and provided with a valve member 44 configured to selectively connect an interior of the suction pile 10 to an exterior of the suction pile 10. The automatically-separable suction anchor system also includes an operation-supporting tubular body 50 configured to downwardly press the valve member 44, thereby causing a suction hole 52 to communicate with the interior of the suction pile 10, a frame 60 configured to support the operation-supporting tubular body 50 and connected, at an upper portion thereof, to a crane while being selectively connected, at a lower portion thereof, to the suction pile 10 by clamps 70, and a suction device 20 including an operating pump 80 having a modular structure including pumps 82, 84, and 86 configured to perform suction operation and drawing operation and coupled to the operation-supporting tubular body 50, for connection thereof to the operation-supporting tubular body 50. The automatically-separable suction anchor system further includes a control module 90 configured to control operation of the clamps 70 and operation of the operating pump 80.

This will be described in more detail.

As shown in FIGS. 1, 2, and 3, the suction pile 10, which will penetrate a sea bead, has a hollow structure closed by the blocking plate 12 at a head portion thereof. A through hole 12A is formed at a central portion of the blocking plate 12. Pull-up brackets 14 are formed on an upper surface of the blocking plate 12 at opposite sides with reference to the through hole 12A, to protrude upwards. Each of the pull-up brackets 14 is provided with a clamp coupling hole 14A. The pull-up brackets 14 are coupled to or separated from first and second supports 62 and 64 of the frame 60 by the clamps 70, respectively. Each pull-up bracket 14 is formed such that the pull-up bracket 14 has a width gradually increasing as the pull-up bracket 14 extends downwards from an upper end thereof formed with the clamp coupling hole 14A while having a smallest width at the upper end. Accordingly, the pull-up bracket 14 has sufficient pull-up rigidity.

The opening/closing unit 40 including the valve member 44 is provided at the through hole 12A of the blocking plate 12 in order to selectively open or close the through hole 12A.

Figure 5:
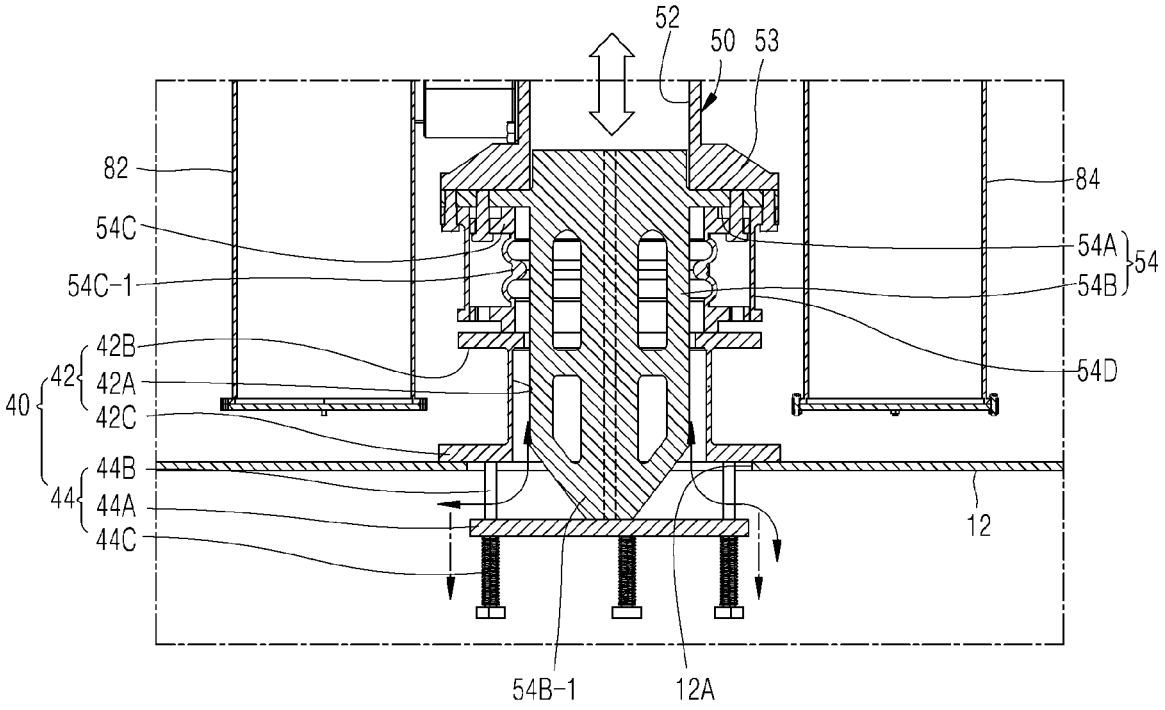
FIG. 5 is an enlarged cross-sectional view explaining operation of a pressing opening/closing part shown in FIG. 3.

As shown in FIGS. 3 and 5, the opening/closing unit 40 is configured through inclusion of a hollow fixed tubular member 42 formed with an insertion hole 42A at a central portion thereof while being formed with upper and lower flanges 42B and 42C at upper and lower ends thereof, the lower flange 42C being coupled to the upper surface of the blocking plate 12 such that the insertion hole 42A communicates with the interior of the suction pile 10 through the through hole 12A. The valve member 44, which is also included in the opening/closing unit 40, is coupled to a lower surface of the lower flange 42C such that the valve member 44 is disposed in the interior of the suction pile 10, and is configured to open the insertion hole 42A when downward pressing force is generated.

As described above, the fixed tubular member 42 is formed to have a hollow structure, and is formed, at the lower end thereof, with the lower flange 42C configured to be coupled to the blocking plate 12 while being formed, at the upper end thereof, the upper flange 42B configured to have a flat structure such that an elastic connector 58 is coupled to the upper flange 42B in a tight contact state. The upper flange 42B and the lower flange 42C have an annular shape. Since the upper flange 42B is formed to be horizontally flat, a lower end of the elastic connector 58 may be coupled to the upper flange 42B while stably maintaining air tightness. A fitting groove may be formed at an upper surface of the upper flange 42B corresponding to the lower end of the elastic connector 58 in order to increase air tightness force to the elastic connector 58. As a lower end of an elastic force generating portion 58B constituting the elastic connector 58 is maintained in a state of being fitted in the fitting groove, air tightness may be enhanced.

The valve member 44 includes an opening/closing plate 44A disposed to be selectively brought into contact with the lower surface of the lower flange 42C in order to open or close the insertion hole 42A at an inside of the suction pile 10, a plurality of support bolts 44B coupled to the lower surface of the lower flange 42C while extending through an edge of the opening/closing plate 44A, and elastic members 44C respectively provided between heads of the support bolts 44B and a lower surface of the opening/closing plate 44A and configured to elastically support the opening/closing plate 44A when external force downwardly pressing the opening/closing plate 44A disappears, thereby causing the opening/closing plate 44A to be brought into tight contact with an area around the insertion hole 42A. In accordance with such a configuration, the insertion hole 42A is opened when a pressing member 54B is inserted into the insertion hole 42A, thereby downwardly pressing the opening/closing plate 44A, whereas the insertion hole 42A is closed when pressing member 54B moves upwards such that pressing force disappears, thereby causing the opening/closing plate 44A to move upwards by elastic force of the elastic member 44C and, as such, to be brought into tight contact with the lower surface of the lower flange 42C.

This will be described in more detail. When the suction device 20 moves downwards, thereby causing the pressing member 54B of the operation-supporting tubular body 50 to downwardly press the opening/closing plate 44A, the insertion hole 42A and the suction hole 52 communicate with the interior of the suction pile 10. On the other hand, when the suction device 20 moves upwards, thereby causing the pressing member 54B to move upwards, the opening/closing plate 44A is brought into tight contact with the lower surface of the lower flange 42C while moving upwards by the elastic member 44C, thereby closing the insertion hole 42A.

The suction device 20 has a modularized and integrated structure of the operating pump 80 configured to outwardly drain air and sea water present in the interior of the suction pile 10 through the insertion hole 42A, for penetration of the sea bed with the suction pile 10, and to inject ambient air or sea water into the interior of the suction pile 10, for drawing of the suction pile 10, the operation-supporting tubular body 50 connected to the operating pump 80 while being selectively connected to the opening/closing unit 40, and the frame 60 configured to support the operating pump 80 and the operation-supporting tubular body 50 and selectively coupled to the suction pile 10 by the clamps 70 while being connectable to a crane (not shown).

As shown in FIGS. 1 to 3, the operation-supporting tubular body 50, which is a core of the suction device 20, is formed to have a hollow structure and, as such, the suction hole 52 is formed at an inside of the operation-supporting tubular body 50, and a pressing opening/closing part 54 is provided at a lower end of the operation-supporting tubular body 50. The pressing opening/closing part 54 is configured to cause the suction hole 52 to communicate with the interior of the suction pile 10 when the operation-supporting tubular body 50 is coupled to the valve member 44 of the opening/closing unit 40. The operation-supporting tubular body 50 is vertically disposed.

An air discharge unit 57 is provided at an upper portion of the operation-supporting tubular body 50, and the pressing opening/closing part 54 is provided at the lower portion of the operation-supporting tubular body 50.

Figure 7:
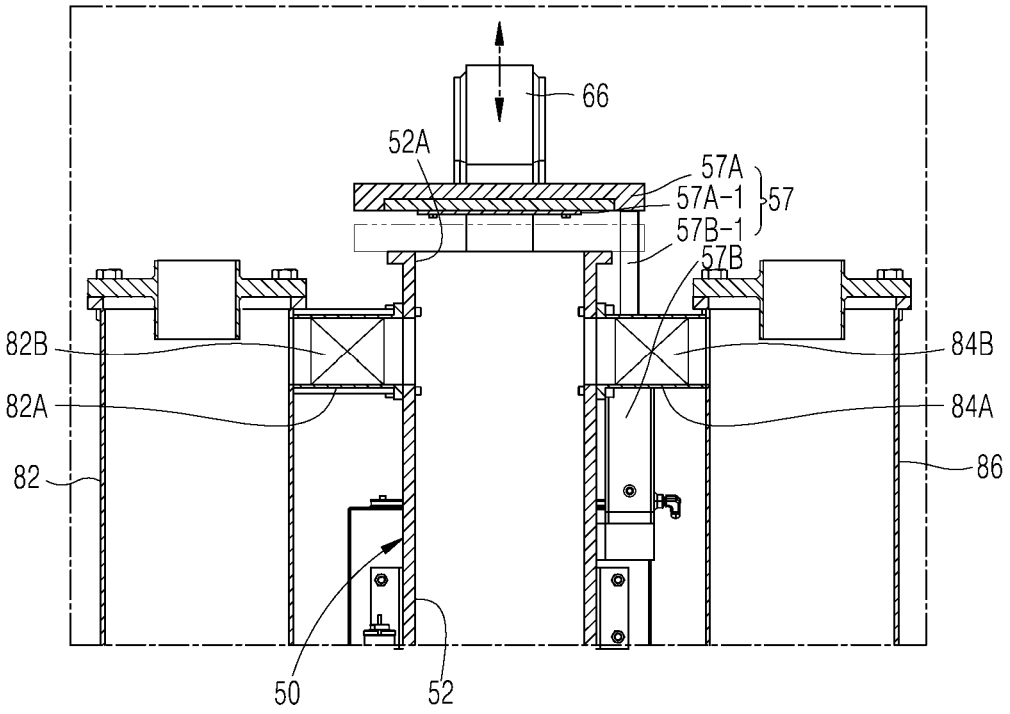
FIG. 7 is a schematic cross-sectional view explaining an operation procedure of an air discharge unit shown in FIG. 1.

The air discharge unit 57 is operated by the control module 90, and is configured to discharge air present in the interior of the suction pile 10 and the interior of the suction hole 52 when the suction device 20 is submerged in sea water. As shown in FIGS. 1 and 7, the air discharge unit 57 includes an opening/closing member 57A configured to selectively open or close a discharge hole 52A formed at the upper end of the operation-supporting tubular body 50, and air-discharging actuators 57B installed at the upper portion of the operation-supporting tubular body 50 and configured to upwardly move the opening/closing member 57A, thereby opening the discharge hole 52A, and to downwardly move the opening/closing member 57A, thereby closing the discharge hole 52A. A tight contact member 57A-1 made of a synthetic resin material or a rubber material is further provided at a lower surface of the opening/closing member 57A. The tight contact member 57A-1 tightly contacts an inlet of the discharge hole 52A.

Each air-discharging actuator 57B is coupled to a side surface of the upper portion of the operation-supporting tubular body 50. Ends of actuation rods 57B-1 of respective air-discharging actuators 57B are coupled to opposite sides of the opening/closing member 57A, respectively. Accordingly, when each air-discharging actuator 57B performs a forward movement operation (withdrawal), the actuation rod 57B-1 thereof upwardly moves the opening/closing member 57A to open the discharge hole 52A, thereby enabling discharge of air. On the other hand, when each air-discharging actuator 57B performs a backward movement operation (insertion), the actuation rod 57B-1 thereof downwardly moves the opening/closing member 57A to cause the tight contact member 57A-1 of the opening/closing member 57A to be brought into tight contact with an area around the inlet of the discharge hole 52A, thereby closing the discharge hole 52A.

As shown in FIGS. 1, 3, and 5, the pressing opening/closing part 54 is configured to operate the opening/closing unit 40 such that the opening/closing unit 40 is opened when the suction device 20 is coupled to the suction pile 10, thereby causing the suction hole 52 to communicate with the interior of the suction pile 10, whereas connection between the suction hole 52 and the interior of the suction pile 10 is prevented when the suction device 20 is separated from the suction pile 10.

The pressing opening/closing part 54 includes a press-supporting flange 54A coupled to a tubular flange 53 provided at a lower end of the operation-supporting tubular body 50, and a pressing member 54B coupled to the press-supporting flange 54A such that an upper end thereof is disposed at an inner edge of the press-supporting flange 54A. The pressing member 54B is formed with a pressing end 54B-1 at a lower end thereof, to downwardly press the valve member 44.

As shown in FIGS. 1 and 4, the pressing member 54B is constituted by at least two plates coupled to each other, to form a "+" shape, such that a channel is formed therebetween. An upper end of the pressing member 54B is disposed inside the press-supporting flange 54A and within the suction hole 52, and a lower end of the pressing member 54B is formed to have a width gradually decreasing as the lower end extends downwards.

Although not shown, the pressing member 54B may be constituted by a hollow tube having a conical shape at a lower end thereof while being formed with a plurality of holes.

An elastic connector 54C is provided at a lower surface of the above-described press-supporting flange 54A. When the pressing member 54B is inserted into the insertion hole 42A and, as such, downwardly presses the valve member 44, thereby opening the insertion hole 42A, and the clamps 70 are coupled to the frame 60 and respective pull-up brackets 14, the elastic connector 54C is brought into tight contact with the upper surface of the upper flange 42B of the fixed tubular member 42, to maintain air tightness, and causes the insertion hole 42A and the suction hole 52 to communicate with each other.

As shown in FIGS. 1 and 3, the elastic connector 54C has a hollow structure such that the pressing member 54B is disposed therein. An upper end of the elastic connector 54C is coupled to the lower surface of the press-supporting flange 54A, and an elastic force generating portion 54C-1 configured to generate elastic force in upward and downward directions is formed at a middle portion of the elastic connector 54C. The elastic force generating portion 54C-1 is formed to have a crease shape in order to generate elastic force in a downward direction.

A protection tubular member 54D is provided at the lower surface of the above-described press-supporting flange 54A. The protection tubular member 54D is formed to have a hollow structure such that the elastic connector 54C is disposed therein. The protection tubular member 54D is coupled to the lower surface of the press-supporting flange 54A at an upper end thereof, to protect the elastic connector 54C from foreign matter or external force. The protection tubular member 54D is formed to have a smaller length than that of the elastic connector 54C in order to prevent interference thereof with the elastic connector 54C when the elastic connector 54C extends or retracts in an upward or downward direction. The protection tubular member 55D may be made of a synthetic resin material, a rubber material, or a metal material.

The frame 60 supports the operation-supporting tubular body 50 and the operating pump 80, to integrate the operation-supporting tubular body 50 and the operating pump 80 with each other. An upper end of the frame 60 is connected to a crane (not shown), and a lower portion of the frame 60 is coupled to or separated from each pull-up bracket 14 by each clamp 70. The frame 60 is constituted by the first and second supports 62 and 64 respectively coupled to upper and lower portions of the operation-supporting tubular body 50 at opposite sides of the operation-supporting tubular body 50.

As shown in FIGS. 1 and 4, the first support 62 includes a pair of support plates 62A coupled to each other by a connecting bracket while being spaced apart from each other such that an upper coupling space S1 and a lower coupling space S2 are formed therebetween. Similarly, the second support 64 includes a pair of support plates 64A coupled to each other by a connecting bracket while being spaced apart from each other such that an upper coupling space S1 and a lower coupling space S2 are formed therebetween. A pull-up ring 66 configured to be connected to a crane is coupled, at one end thereof, to each upper coupling space S1. When the suction device 20 moves downwards, the pull-up brackets 14 are inserted into the lower coupling spaces S1, respectively.

Frame coupling holes 62D and 64D are formed through the first and second supports 62 and 64 in regions corresponding to the lower coupling spaces S2, respectively. The frame coupling holes 62D and 64D are aligned with the clamp coupling holes 14A, respectively, when the pull-up brackets 14 are inserted into the lower coupling spaces S2, respectively.

The clamps 70 are coupled to the first and second supports 62 and 64 outside regions where the frame coupling holes 62D and 64D are formed, respectively.

Upper and lower coupling ends 62C and 64C to be coupled to the operation-supporting tubular body 50 are formed at the first and second supports 62 and 64, respectively, to extend horizontally. As the support plates 62A are coupled to each other while being spaced apart from each other, the first support 62 has sufficient rigidity. Similarly, as the support plates 64A are coupled to each other while being spaced apart from each other, the second support 64 has sufficient rigidity. In addition, the upper and lower coupling ends 62C and 64C are coupled to the operation-supporting tubular body 50 by bolts or the like, for connection and disconnection thereof to and from the operation-supporting tubular body 50. The first and second supports 62 and 64 are coupled to the operation-supporting tubular body 50 such that the first and second supports 62 and 64 are symmetrically disposed at opposite sides of the operation-supporting tubular body 50.

When the pull-up brackets 14 are inserted into the lower coupling spaces S2 such that the frame coupling holes 62D and 64D are aligned with respective clamp coupling holes 14A, the clamps 70 are inserted into respective frame coupling holes 62D and 64D and respective clamp coupling holes 14A and, as such, couple the pull-up brackets 14 and the first and second supports 62 and 64 to each other such that the pull-up brackets 14 and the first and second supports 62 and 64 are integrated with each other.

Each clamp 70 includes an actuator 72 coupled to an outer one of the support plates 62A or 64A of the first or second support 62 or 64 in a region corresponding to the lower coupling space S2. Each clamp 70 also includes an actuation rod 74 configured to be coupled, in a fitting manner, to corresponding ones of the frame coupling holes 62D and 64D formed at the support plates 62A and 64A and the clamp coupling hole 14A formed at a corresponding one of the pull-up brackets 14 in accordance with a forward movement operation of the actuator 72, thereby integrating corresponding ones of the support plates 62A and 64A and the corresponding pull-up bracket 14 with each other. The actuator rod 74 is also configured to be separated from the corresponding ones of the frame coupling holes 62D and 64D and the corresponding clamp coupling hole 14A in accordance with a backward movement operation of the actuator 72, thereby separating the corresponding ones of the support plates 62A and 64A and the corresponding pull-up bracket 14 from each other.

As shown in FIGS. 1 and 2, the clamps 70 are installed at the first support 62 and the second support 64, respectively.

Figure 6:
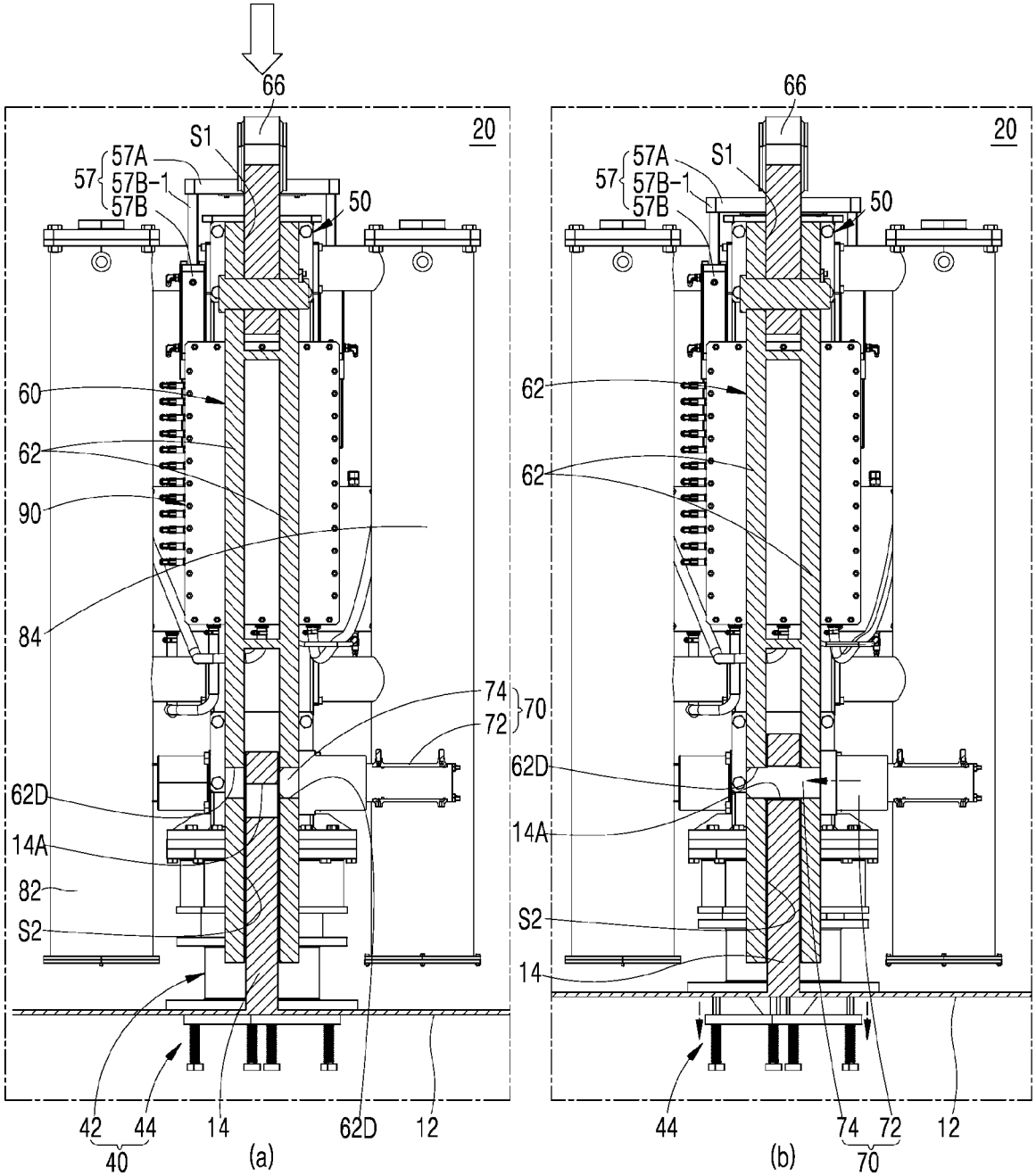
FIGS. 6(*a*) and 6(*b*) are cross-sectional views explaining operation of clamps shown in FIG. 2.

When the pull-up brackets 14 are inserted into respective lower coupling spaces S2 in accordance with downward movement of the suction device 20, as shown in FIG. 6(*a*), and the frame coupling holes 62D and 64D are subsequently aligned with corresponding ones of the clamp coupling holes 14A, as shown in FIG. 6(*b*), the actuation rods 74 of the clamps 70 are fitted in corresponding ones of the frame coupling holes 62D and 64D and the clamp coupling holes 14A in accordance with forward movement operation of the actuators 72. In accordance with this procedure, the frame 60 and the pull-up brackets 14 may be coupled to each other. In addition, when the actuation rods 74 are separated from corresponding ones of the frame coupling holes 62D and 64D and the clamp coupling holes 14A in accordance with backward movement operation of the actuators 72, the frame 60 is separated from the pull-up brackets 14. These operations are automatically carried out.

For example, when the pressing member 54B is inserted into the insertion hole 42A, thereby completely downwardly pressing the opening/closing plate 44A, and the completely downwardly pressed state of the opening/closing plate 44A is sensed by a pressure gauge 92B or another sensor, or stopping of the downward pressing is mechanically sensed, it is determined that corresponding ones of the frame coupling holes 62D and 64D and the clamp coupling holes 14A have been aligned with each other. In accordance with this determination, the actuators 72 of the clamps 70 perform forward movement operation, thereby coupling the frame 60 and the pull-up brackets 14 to each other. In addition, the frame 60 and the pull-up brackets 14 may be separated from each other by performing backward movement operation of the actuators 72 of the clamps 70 in a coupled state of the frame 60 and the pull-up brackets 14.

The operating pump 80 performs suction operation or pull-up operation when the pressing opening/closing part 54 is coupled to the valve member 44, and the first and second supports 62 and 64 disposed at opposite sides of the frame 60 integrated with the operation-supporting tubular body 50 are coupled to the pull-up brackets 14 of the suction pile 10 by the clamps 70.

The operating pump 80 includes a first pump 82 of high capacity and a second pump 84 of high head for penetration of the suction pile 10, and a third pump 86 for drawing of the suction pile 10. The first, second, and third pumps 82, 84, and 86 include respective inlet/outlet ports 82A, 84A, and 86A provided with respective valves 82B, 84B, and 86B and, as such, are coupled to the operation-supporting tubular body 50. The inlet/outlet ports 82A, 84A, and 86A of the first, second, and third pumps 82, 84, and 86 are coupled to the operation-supporting tubular body 50 such that the inlet/outlet ports 82A, 84A, and 86A communicate with the suction hole 52 of the operation-supporting tubular body 50. The inlet/outlet ports 82A, 84A, and 86A are opened or closed by respective valves 82B, 84B, and 86B.

The first pump 82, which has a high-capacity pumping function, is configured to generate a low pumping pressure, but to have a high pumping capacity, and, as such, operates in the case in which the soil of the sea bed is constituted by sand or the like. The second pump 84, which has a high-head pumping function, is configured to have a low pumping capacity, but to generate a high pumping pressure, and, as such, operates in the case in which the soil of the sea bead is constituted by clay, muds, or the like. The first and second pumps 82 and 84 as described above are used to outwardly drain water present in the suction pile 10 through suction hole 52 when the suction pile 10 penetrates the sea bed.

The third pump 86 is used to inject water present at an outside of the suction hole 52 into the suction pile 10 through the suction hole 52 when the suction pile 10 is drawn.

Figure 11:
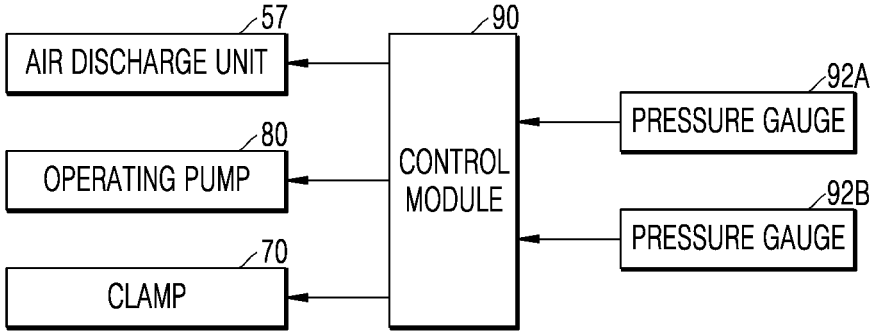
FIG. 11 is a schematic block diagram explaining a control module according to an embodiment of the present invention.

As shown in FIGS. 3 and 11, the control module 90 is provided at the operation-supporting tubular body 50 and is configured to control operation of the operating pump 80, the clamps 70, and the air discharge unit 57.

The control module 90 includes pressure gauges 92A and 92B installed at the operation-supporting tubular body 50 and configured to measure a pressure of the suction hole 52 and a pressure at the outside of the suction hole 52, respectively, and valve packs 94 configured to physically operate the operating pump 80, the clamps 70, and the air discharge unit 57, respectively. In addition, the control module 90 may further include a water pressure gauge, a depth gauge, etc. The valve packs 94 are configured to operate respective actuators by a water pressure or a hydraulic pressure. The valve packs 94 are also configured to selectively operate the first pump 82 and the second pump 84 based on a pressure at the inside of the suction hole 52 and a pressure at the outside of the suction hole 52 respectively sensed by the pressure gauges 92A and 92B.

Configurations and operation of the valve packs 94 configured to operate various actuators using a hydraulic pressure or a water pressure under water are well known and, as such, no detailed description thereof will be given.

Hereinafter, suction operation and drawing operation of the automatically-separable suction anchor system according to the embodiment of the present invention, which includes the plurality of pumps, will be described with reference to FIGS. 8 to 11.

Figure 8:
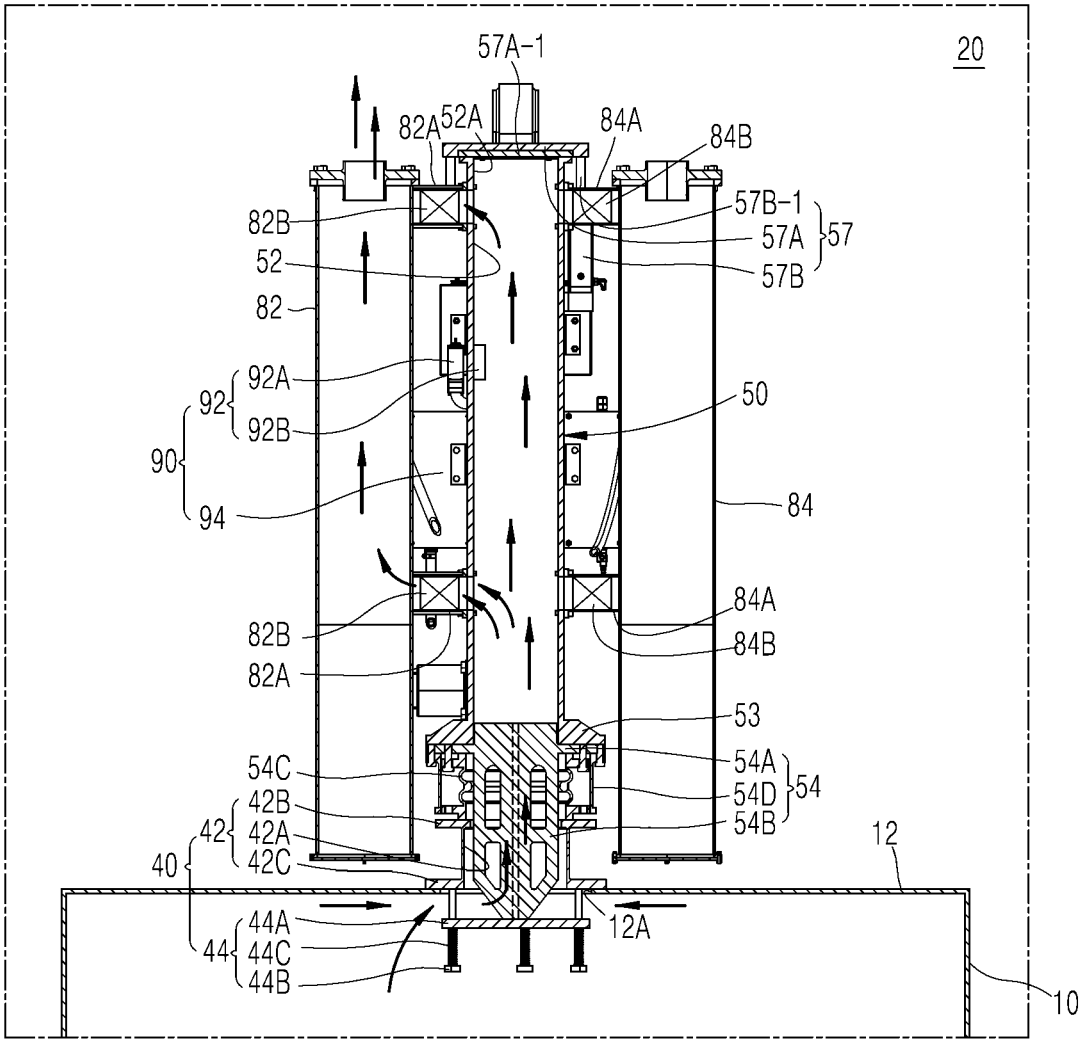
FIG. 8 is a schematic cross-sectional view explaining an operation procedure of a first pump of high capacity shown in FIG. 1.

When the first pump 82, which has a high-capacity pumping function, operates in a state in which the frame 60 is coupled to the pull-up brackets 14 of the suction pile 10 by the clamps 70, as shown in FIG. 8, the pressing member 54B downwardly presses the opening/closing plate 44A, thereby causing the suction hole 52 and the insertion hole 42A to communicate with the interior of the suction pile 10. As a result, a part of air, fluid, soil, and sand present in the interior of the suction pile 10 are discharged in a direction indicated by arrows in FIG. 8.

For example, when the soil of the sea bed, which the suction pile 10 penetrates, is constituted by sand or soft muds, penetration of the suction pile 10 is performed through operation of the first pump 82 capable of performing pumping in a high capacity.

Figure 9:
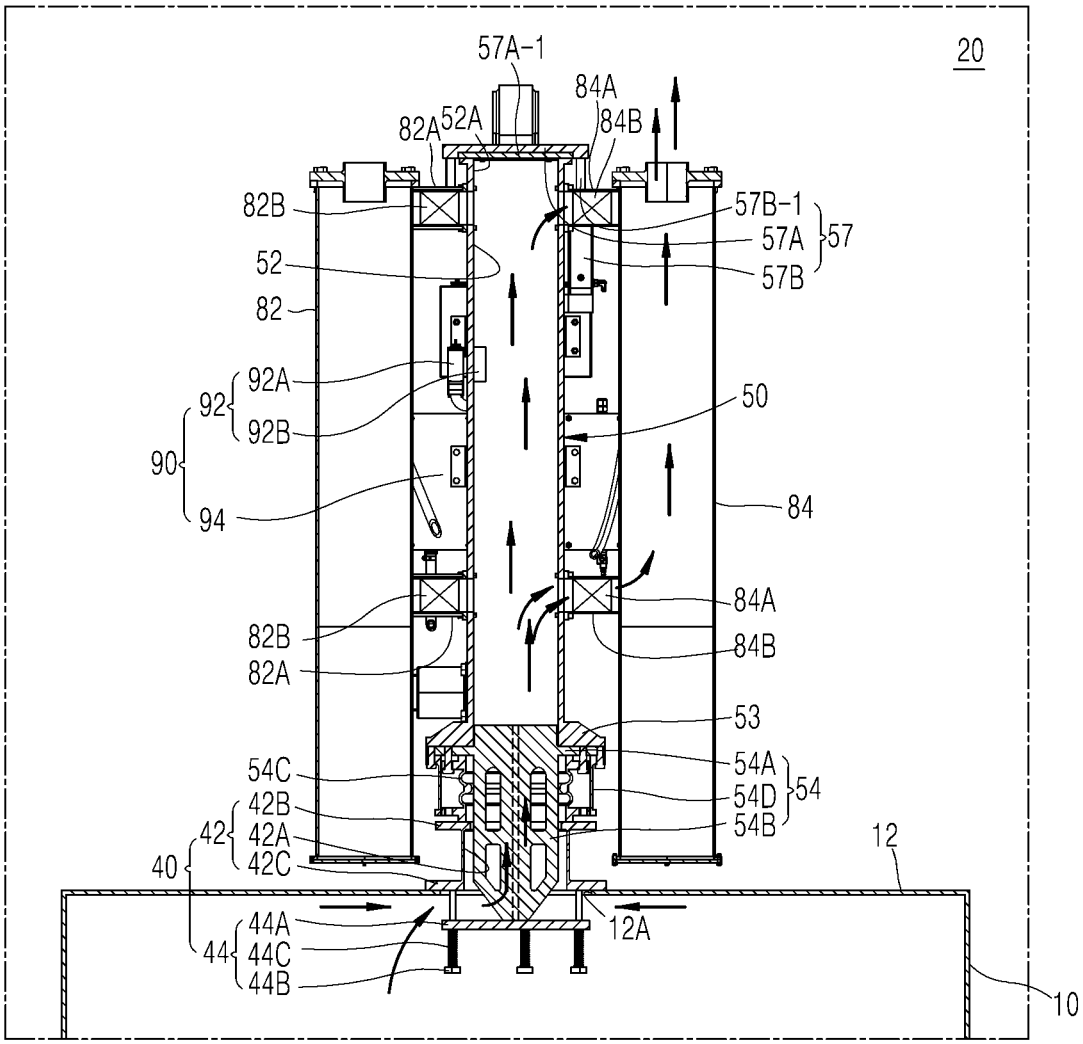
FIG. 9 is a schematic cross-sectional view explaining an operation procedure of a second pump of high head shown in FIG. 1.
Figure 10:
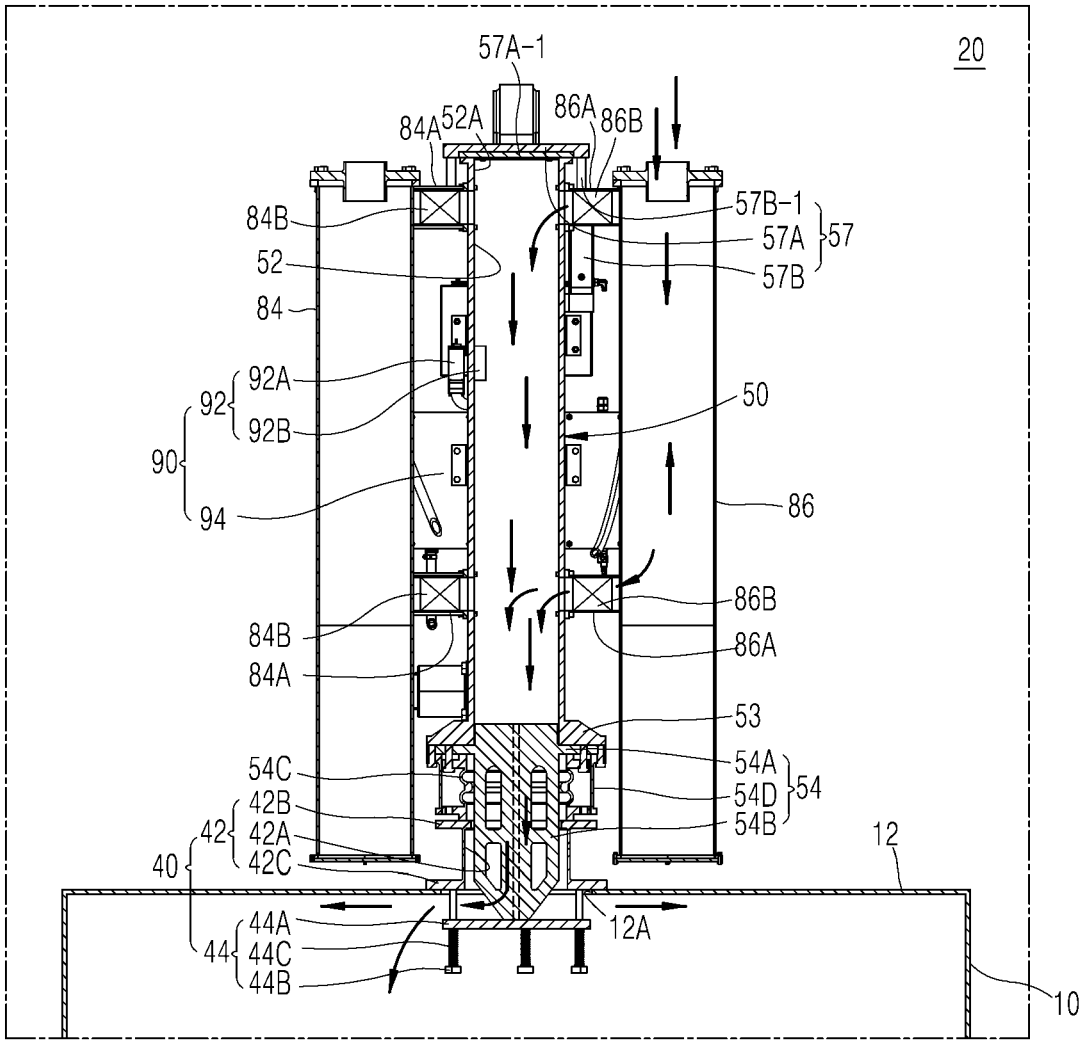
FIG. 10 is a schematic cross-sectional view explaining an operation procedure of a drawing pump shown in FIG. 1.

When a pressure sensed by the pressure gauge 92B installed at the inside of the suction hole 52 is higher than a predetermined pressure or when a penetration speed is lower than a reference speed, the control module 90 determines that the soil of the sea bed, which the suction pile 10 penetrates, is soil that is difficult to penetrate such as clay or soil containing muds having high viscosity. Upon determining that the soil of the sea bed is soil that is difficult to penetrate, the first pump 82 is stopped, and suction is performed under a high pressure by operating the second pump 84 having a high-head pumping function, as shown in FIG. 9.

In this case, the control module 90 previously checks a variation in soil quality according to a depth of the sea bed which the suction pile 10 will penetrate, and senses a penetration depth of the suction pile 10. Based on results of the checking and sensing, the control module 90 may selectively operate the first pump 82 or the second pump 84.

In order to draw the suction pile 10 having penetrated the sea bed, the frame 60 of the suction device 20 is coupled to the pull-up brackets 14 of the suction pile 10 using the clamps 70. In accordance with coupling of the suction device 20 to the suction pile 10, the pressing member 54B downwardly presses the opening/closing plate 44A, thereby causing the suction hole 52 and the insertion hole 42A to communicate with the interior of the suction pile 10. When the third pump 86 subsequently operates, water present at the outside of the suction hole 52 is supplied to the interior of the suction pile 10 via the suction hole 52 and the insertion hole 42A through the third pump 86. As the internal pressure of the suction pile 10 is increased, the suction pile 10 may be drawn.

This will be described in more detail.

When the third pump 86 operates in a state in which chains of the crane are connected to the pull-up rings 66, water present at the outside of the suction pile 10 is supplied to the interior of the suction pile 10 and, as such, the internal pressure of the suction pile 10 is increased. As a result, a pressure (a drawing pressure) is exerted in a direction reverse to a penetration direction. When the pull-up rings 66 are pulled up under the condition that a drawing pressure is exerted in the interior of the suction pile 10, the suction pile 10 is drawn.

As described above, it may be possible to efficiently perform penetration of the suction pile 10, taking into consideration a variation in soil quality of a sea bed, which the suction pile 10 penetrates, using the first pump 82 of high capacity or the second pump 84 of high head in accordance with the soil quality variation.

'In addition, parts of the firm frame 60 are installed at opposite sides of the operation-supporting tubular body 50, respectively, and are coupled to the pull-up brackets 14 of the suction pile 10 by the clamps 70, respectively. Accordingly, safety may be secured when the suction pile 10, which is heavy, is pulled up.

As apparent from the above description, the automatically-separable suction anchor system according to the embodiment of the present invention includes an opening/closing unit including a blocking plate provided at an upper surface of a suction pile while including pull-up brackets, and a valve member disposed within the suction pile, a suction device including an operation-supporting tubular body provided with a pressing opening/closing part, a frame provided with clamps, and an operating pump provided at the operation-supporting tubular body while including a first pump of high capacity and a second pump of high head configured to selectively operate when a pressing opening/closing part is coupled to the valve member, thereby performing penetration of the suction pile, and a third pump configured to perform drawing of the suction pile, and a control module configured to control operation of the operating pump and operation of the clamps. Accordingly, a selected one of the pumps may be used in accordance with a variation in soil quality of the sea bed and, as such, it may be possible to safely and stably pull up a heavy pile. In this regard, the automatically-separable suction anchor system according to the embodiment of the present invention, which includes a plurality of pumps, is usable for installation of an offshore structure and, as such, has industrial applicability.'

In accordance with the embodiment of the present invention, the automatically-separable suction anchor system is configured to sense a variation in the quality of a soil constituting a sea bed through sensing of pressures at the inside and outside of the operation-supporting tubular body, and then to operate the high-head pump or the high-capacity pump based on sensed results. Accordingly, it may be possible to provide an effect achieving efficient penetration of a suction pile even when a variation in soil quality occurs during penetration of the suction pile.

In addition, since the frame is constituted by the first and second supports having a weldless high-rigidity structure, the frame may withstand high load during pull-up of the suction pile. Accordingly, it may be possible to provide an effect of securing safety.

In addition, since the frame may be rapidly coupled to or separated from the pull-up brackets of the suction pile by the clamps provided at opposite sides of the frame, the task of connecting or separating the suction device to or from the suction pile may be rapidly and easily achieved. Furthermore, the elastic connector is provided at the pressing opening/closing part disposed at the lower portion of the operation-supporting tubular body. Accordingly, even though a gap is formed between the pressing opening/closing part and the fixed tubular member when the frame is coupled to the pull-up brackets by the clamps, air tightness is maintained by the elastic connector. Accordingly, it may be possible to provide an effect preventing introduction of external water during suction operation.

Although the preferred embodiments of the present disclosure have been disclosed for illustrative purposes, those skilled in the art will appreciate that various modifications, additions and substitutions are possible, without departing from the scope and spirit of the disclosure as disclosed in the accompanying claims.'

Simple modifications and alterations fall within the scope of the disclosure, and the protection scope of the disclosure will be apparent from the appended claims.

What is claimed is:

1. An automatically-separable suction anchor system comprising:

an opening/closing unit comprising a blocking plate comprising a through hole formed at an upper surface of a suction pile, and pull-up brackets respectively formed at opposite sides with reference to the through hole, to protrude upwards, and a valve member disposed at an interior of the suction pile, to cause the interior of the suction pile to selectively communicate with an exterior of the suction pile;

a suction device comprising an operation-supporting tubular body formed to have a hollow structure formed with a suction hole therein, the operation-supporting tubular body being vertically disposed and provided, at a lower end thereof, with a pressing opening/closing part configured to enable the suction hole to communicate with the interior of the suction pile, a frame comprising clamps respectively provided at a lower portion of the frame in opposite end regions and configured to be selectively coupled to the pull-up brackets, and first and second supports each formed with upper and lower coupling ends to be coupled to upper and lower portions of the operation-supporting tubular body at opposite sides of the operation-supporting tubular body, respectively, and an operating pump coupled to the operation-supporting tubular body, the operating pump comprising a first pump of high capacity and a second pump of high head configured to perform penetration of the suction pile through selective operation thereof, and a third pump configured to perform drawing of the suction pile; and a control module provided at the operation-supporting tubular body and configured to control operation of the operating pump and operation of the clamps.

2. The automatically-separable suction anchor system according to claim 1, wherein the opening/closing unit comprises:

a hollow fixed tubular member formed with an insertion hole at a central portion thereof while being formed with upper and lower flanges at upper and lower ends thereof, the lower flange being coupled to the blocking plate such that the insertion hole communicates with the interior of the suction pile through the through hole; and the valve member coupled to a lower surface of the lower flange such that the valve member is disposed in the interior of the suction pile, the valve member being configured to open the insertion hole when the pressing opening/closing part performs downward pressing.

3. The automatically-separable suction anchor system according to claim 2, wherein the pressing opening/closing part comprises:

a press-supporting flange coupled to a tubular flange provided at a lower end of the operation-supporting tubular body; and a pressing member coupled to the press-supporting flange such that an upper end thereof is disposed at an inner edge of the press-supporting flange, the pressing member being formed with a pressing end at a lower end thereof, to downwardly press the valve member.

4. The automatically-separable suction anchor system according to claim 3, wherein the pressing member comprises a hollow tube having a conical shape at a lower end thereof while being formed with a plurality of holes, or comprises at least two plates coupled to each other, to form a "+" shape, such that a channel is formed therebetween.

5. The automatically-separable suction anchor system according to claim 3, wherein:

an elastic connector is provided at a lower surface of the press-supporting flange, and is configured to be brought into tight contact with an upper surface of the upper flange of the fixed tubular member, to maintain air tightness, when the pressing member is inserted into the insertion hole, to downwardly press the valve member, thereby opening the insertion hole, and the clamps are coupled to the frame; and the elastic connector has a hollow structure such that the pressing member is disposed therein, an upper end of the elastic connector is coupled to the lower surface of the press-supporting flange, and an elastic force generating portion configured to generate elastic force in upward and downward directions is formed at a middle portion of the elastic connector.

6. The automatically-separable suction anchor system according to claim 5, wherein:

a protection tubular member is provided at the lower surface of the press-supporting flange;

the protection tubular member is formed to have a hollow structure such that the elastic connector is disposed therein;

the protection tubular member is coupled to the lower surface of the press-supporting flange at an upper end thereof, to protect the elastic connector; and the protection tubular member is formed to have a smaller length than a length of the elastic connector, to prevent interference thereof with the elastic connector when the elastic connector extends or retracts in an upward or downward direction.

7. The automatically-separable suction anchor system according to claim 1, wherein:

each of the first and second supports comprises a pair of support plates coupled to each other while being spaced apart from each other such that an upper coupling space and a lower coupling space are formed therebetween;

a pull-up ring configured to be connected to a crane is coupled to the upper coupling space; and a corresponding one of the pull-up brackets is inserted into the lower coupling space.

8. The automatically-separable suction anchor system according to claim 7, wherein each of the clamps comprises:

an actuator coupled to an outer one of the support plates of a corresponding one of the first and second supports in a region corresponding to the lower coupling space; and an actuation rod configured to be coupled, in a fitting manner, to frame coupling holes formed at the support plates and a clamp coupling hole formed at a corresponding one of the pull-up brackets in accordance with a forward movement operation of the actuator, thereby integrating the support plates and the corresponding pull-up bracket with each other, the actuator rod also being configured to be separated from the frame coupling holes and the clamp coupling hole in accordance with a backward movement operation of the actuator, thereby separating the support plates and the corresponding pull-up bracket from each other.

9. The automatically-separable suction anchor system according to claim 1, wherein:

an air discharge unit is provided at the operation-supporting tubular body, to discharge air present in the interior of the suction pile and an interior of the suction hole when the suction device is submerged in sea water; and the air discharge unit comprises:

an opening/closing member configured to selectively open or close a discharge hole formed at an upper end of the operation-supporting tubular body; and air-discharging actuators installed at an upper portion of the operation-supporting tubular body and configured to upwardly move the opening/closing member, thereby opening the discharge hole, and to downwardly move the opening/closing member, thereby closing the discharge hole.

10. The automatically-separable suction anchor system according to claim 1, wherein the control module comprises pressure gauges installed at the operation-supporting tubular body and configured to measure a pressure of the suction hole and a pressure at the outside of the suction hole, respectively, and the control module selectively operates the first pump and the second pump based on the pressure at the inside of the suction hole and the pressure at the outside of the suction hole respectively sensed by the pressure gauges.

* * * * *